US007014601B2

(12) United States Patent
Savage et al.

(10) Patent No.: US 7,014,601 B2
(45) Date of Patent: Mar. 21, 2006

(54) COMBINED EXERCISE/WEIGHT BENCH/LOWER CABLE STATION DEVICE

(76) Inventors: Michael Savage, 15 Macarthur Dr., Millbury, MA (US) 01527; Donna Savage, 15 Macarthur Dr., Millbury, MA (US) 01527

( * ) Notice: Subject to any disclaimer, the term of this patent is extended or adjusted under 35 U.S.C. 154(b) by 38 days.

(21) Appl. No.: 10/395,644

(22) Filed: Mar. 24, 2003

(65) Prior Publication Data

US 2003/0199373 A1 Oct. 23, 2003

Related U.S. Application Data

(60) Provisional application No. 60/366,673, filed on Mar. 22, 2002.

(51) Int. Cl.
*A63B 26/00* (2006.01)

(52) U.S. Cl. ..... 482/142; 482/102; 482/95; 482/101

(58) Field of Classification Search ..... 482/140, 482/907, 91, 142, 104
See application file for complete search history.

(56) References Cited

U.S. PATENT DOCUMENTS

| | | | | |
|---|---|---|---|---|
| 4,826,157 | A * | 5/1989 | Fitzpatrick | 482/133 |
| 6,273,846 | B1 | 8/2001 | Savage et al. | |
| 6,585,626 | B1 * | 7/2003 | McBride | 482/130 |
| 2003/0114281 | A1 * | 6/2003 | Mackert et al. | 482/123 |

* cited by examiner

*Primary Examiner*—Gregory L. Huson
*Assistant Examiner*—L. Amerson
(74) *Attorney, Agent, or Firm*—Brian M. Dingman

(57) ABSTRACT

A combined exercise/weight bench/lower cable station device. The device includes a bench that is supported in a generally horizontal use position and that is pivoted so that it can be moved up to an upright stowed position and held in place in the stowed position. Also included is a cable riser with a cable running there through. The cable has a weight-carrying saddle coupled to one end, and the other end of the cable extends from the lower portion of the riser underneath the bench when the bench is in the user position. To use the lower cable station function of the device, the bench is pivoted up and out of the way to the stowed position to provide access to the user end of the cable. The weight-carrying saddle is adapted to carry one or more weight plates, dumbbells, or weighted balls, to allow the user to use existing weights.

18 Claims, 17 Drawing Sheets

244
214
250
232
230
224
102a
264
272
222
276
270
274
262
251
260
3lb
3lb
5lb
5lb
8lb
8lb 272
276
270
273
22a
275
80
278
52
81b

COMBINED EXERCISE/WEIGHT BENCH/LOWER CABLE STATION DEVICE

CROSS REFERENCE TO RELATED APPLICATION

This application claims priority of Provisional application serial No. 60/366,673, filed on Mar. 22, 2002.

FIELD OF THE INVENTION

This invention relates to the portable, stowable, exercise/weight bench with a lower cable station device.

BACKGROUND OF THE INVENTION

Weight benches are typically fixed horizontal benches that are very difficult for a homeowner to store. Lower cable station weight training devices, and upper cable station weight training devices typically are relatively large structures that carry a cable coupled on one end to an adjustable series of weight plates, or the like, with the other end adapted to be grasped by the user for the training regime. These devices are typically bulky and difficult to move and store.

SUMMARY OF THE INVENTION

This invention features a combined exercise/weight bench/lower cable station device. The device includes a bench that can pivot from the use position to an upright stowed position, so that the lower cable station can be accessed. There is a cable riser with the cable running through the riser and exiting the riser at its lower end underneath the bench when the bench is in the use position. The cable exits the upper end of the riser and drops down to a weight-carrying saddle coupled to its end. The saddle rides on a saddle guide rod so that it moves smoothly up and down as the lower cable station is used. The saddle is adapted to carry one or more dumbbells, weighted balls, or weight plates so that the amount of weight carried by the cable station is adjustable. This allows the user to place the device against a wall and still access the saddle (to add or remove weights) from either side of the device.

BRIEF DESCRIPTION OF THE DRAWINGS

Other objects, features and advantages will occur to those skilled in the art from the following description of the preferred embodiments and the accompanying drawings in which.

DETAILED DESCRIPTION OF THE PREFERRED EMBODIMENTS

Figure 1:
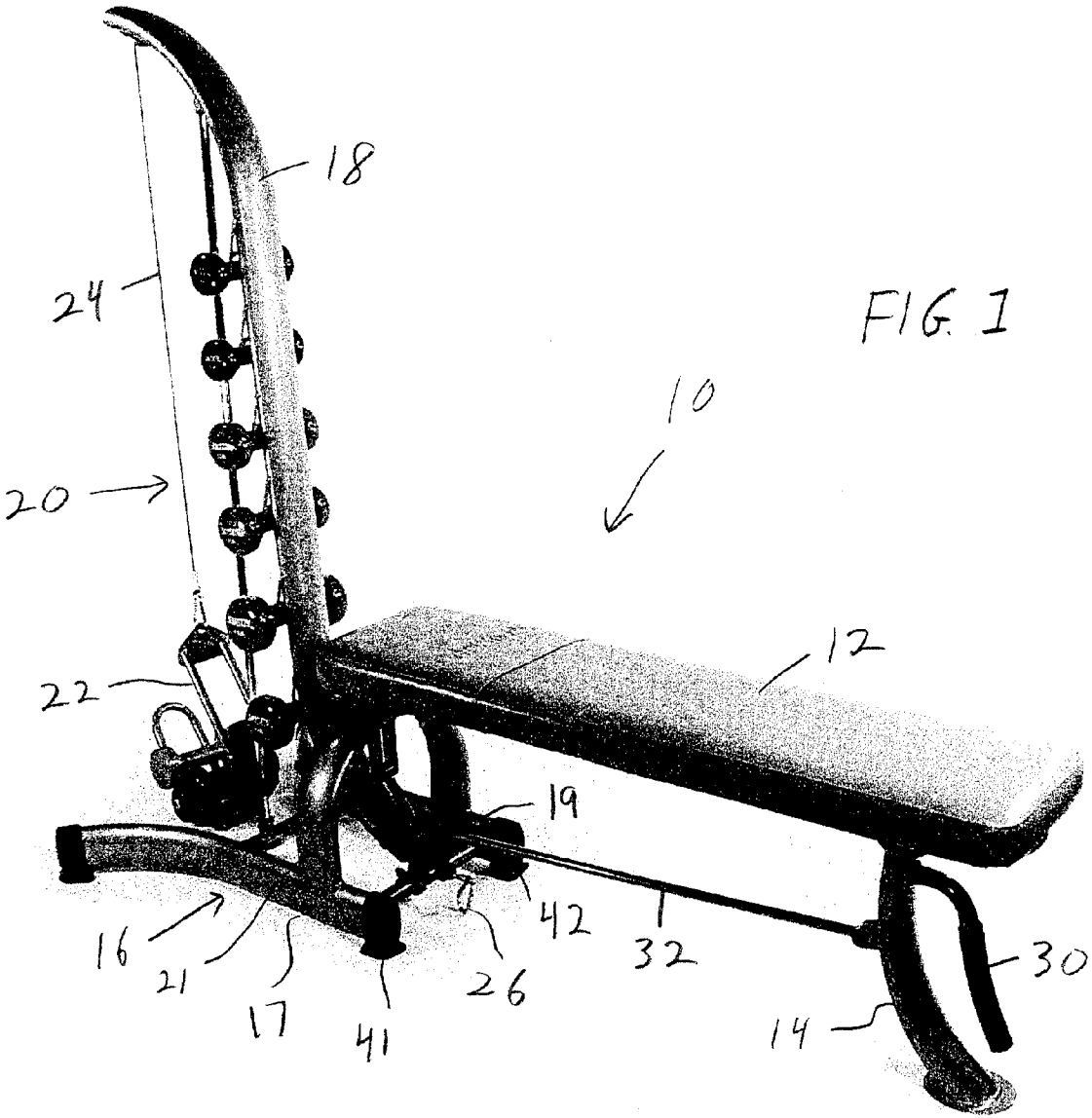
FIG. 1 is a perspective view of one preferred embodiment of the invention with a one piece bench and a weight-carrying saddle adapted to carry dumbbells.

One embodiment of the device is shown in a perspective view in FIG. 1 and in several other views as described above. Device 10 comprises bench 12 supported in its horizontal use position shown in the figure at a front end by bench support leg 14, and at its rear end by bench/cable system support structure 16. Structure 16 comprises horizontal support members 17 and 19 and vertical "U" shaped portion 21. Cable riser 18 routes cable 24 from the weight carrying end having weight-carrying saddle 22, to use end 26 that is under bench 12 when the bench is in the use position shown in FIG. 1. End caps 41 and 42 can be replaced with caps with integrated wheels so that the device is easier to transport, as described below.

Figure 2:
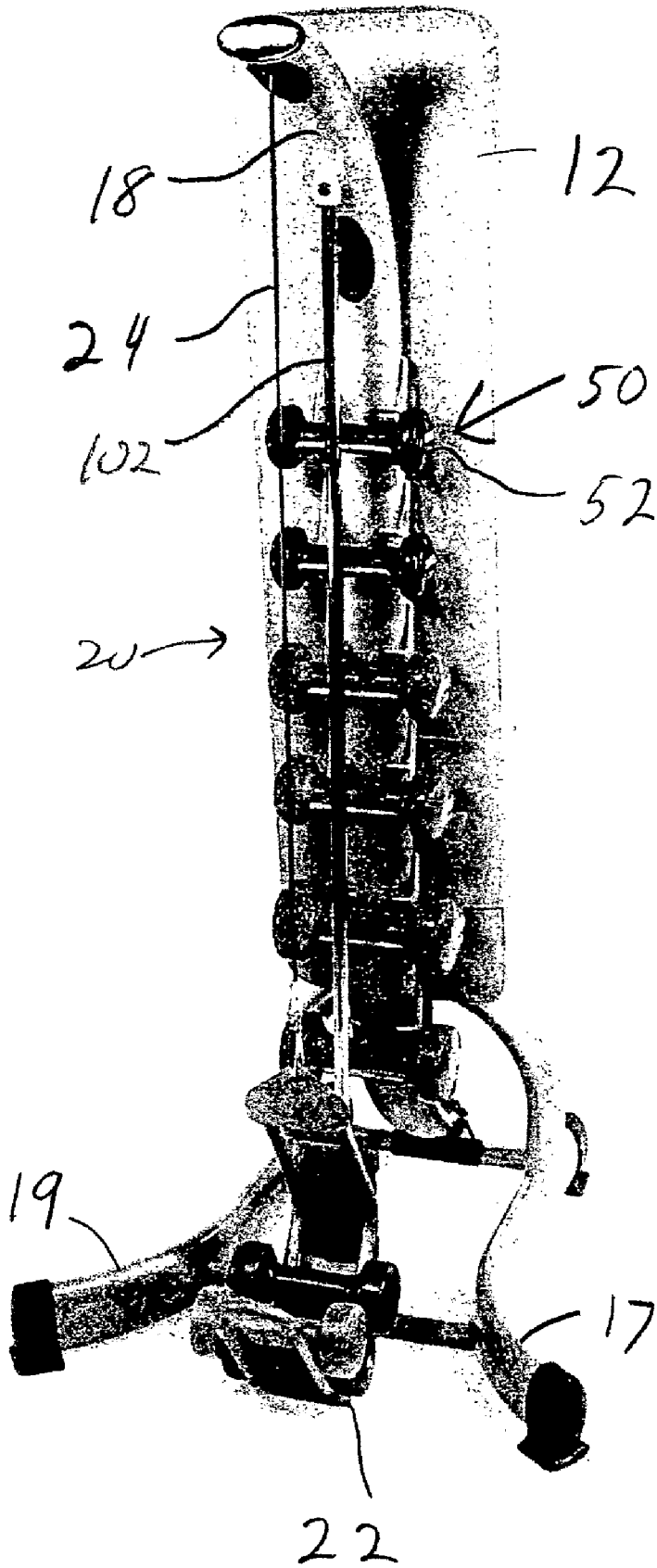
FIG. 2 is a rear perspective view of the device of FIG. 1.
Figure 3:
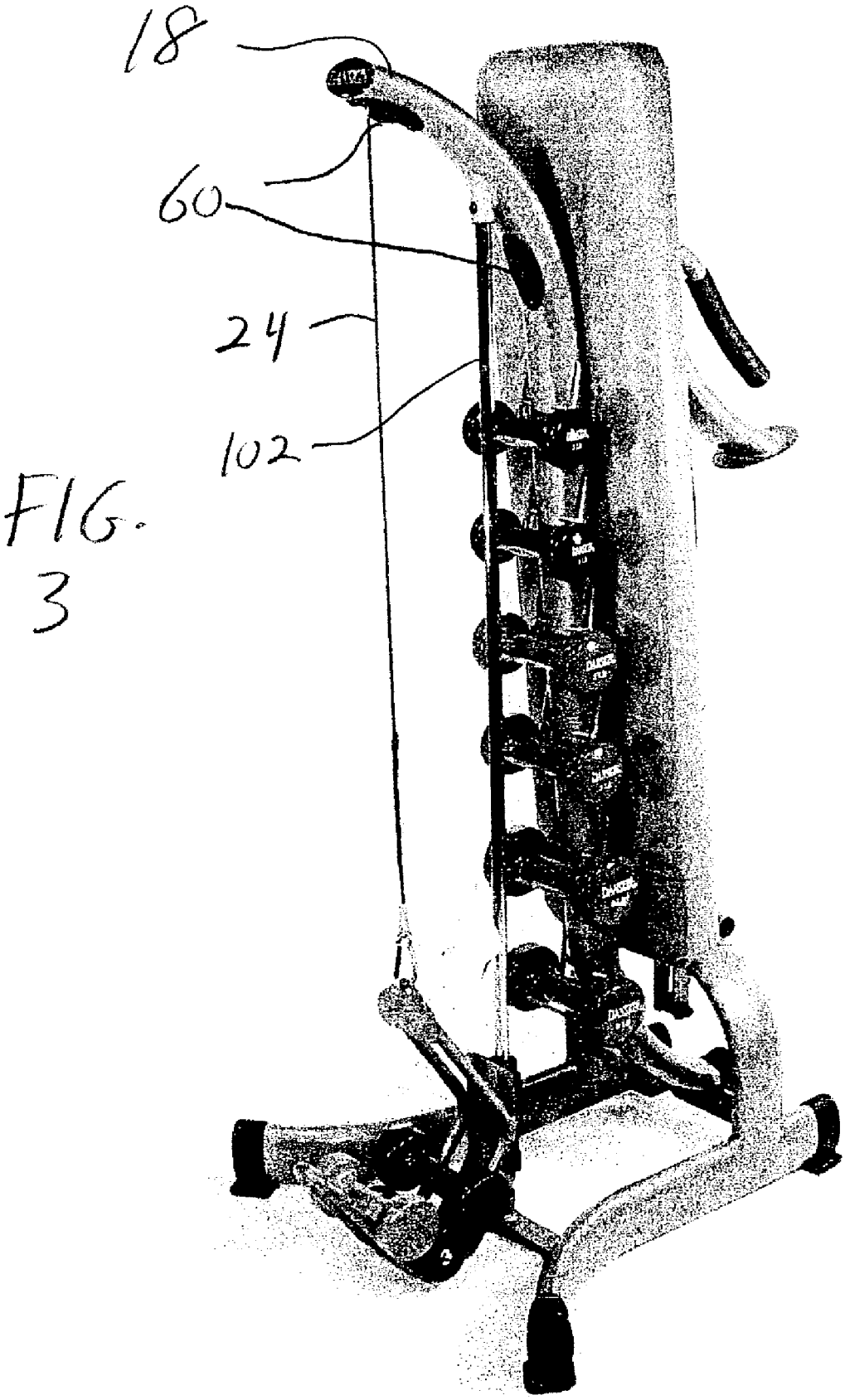
FIG. 3 is another rear perspective view of the device of FIG. 1.

Cable station 20 is better understood with additional references to FIGS. 2 and 3. Saddle 22 rides up and down on saddle travel rod 102 that prevents the saddle from swinging when in use. Dumbbells 52 are held in rack 50 which comprises a number of spaced small racks 51. Saddle 22 as better shown in FIG. 6 comprises two parallel members that are spaced at about the distance between the inner portions of the enlarged ends of dumbbells 52 so that one or more dumbbells can be carried in saddle 22 without substantially bouncing or sliding in use. This saddle feature allows a variable lower cable station pull weight to be accomplished with the dumbbells that are carried in rack 50. Pulleys 60 in riser 18 prevent cable 24 from binding in the riser as it moves.

Figure 4:
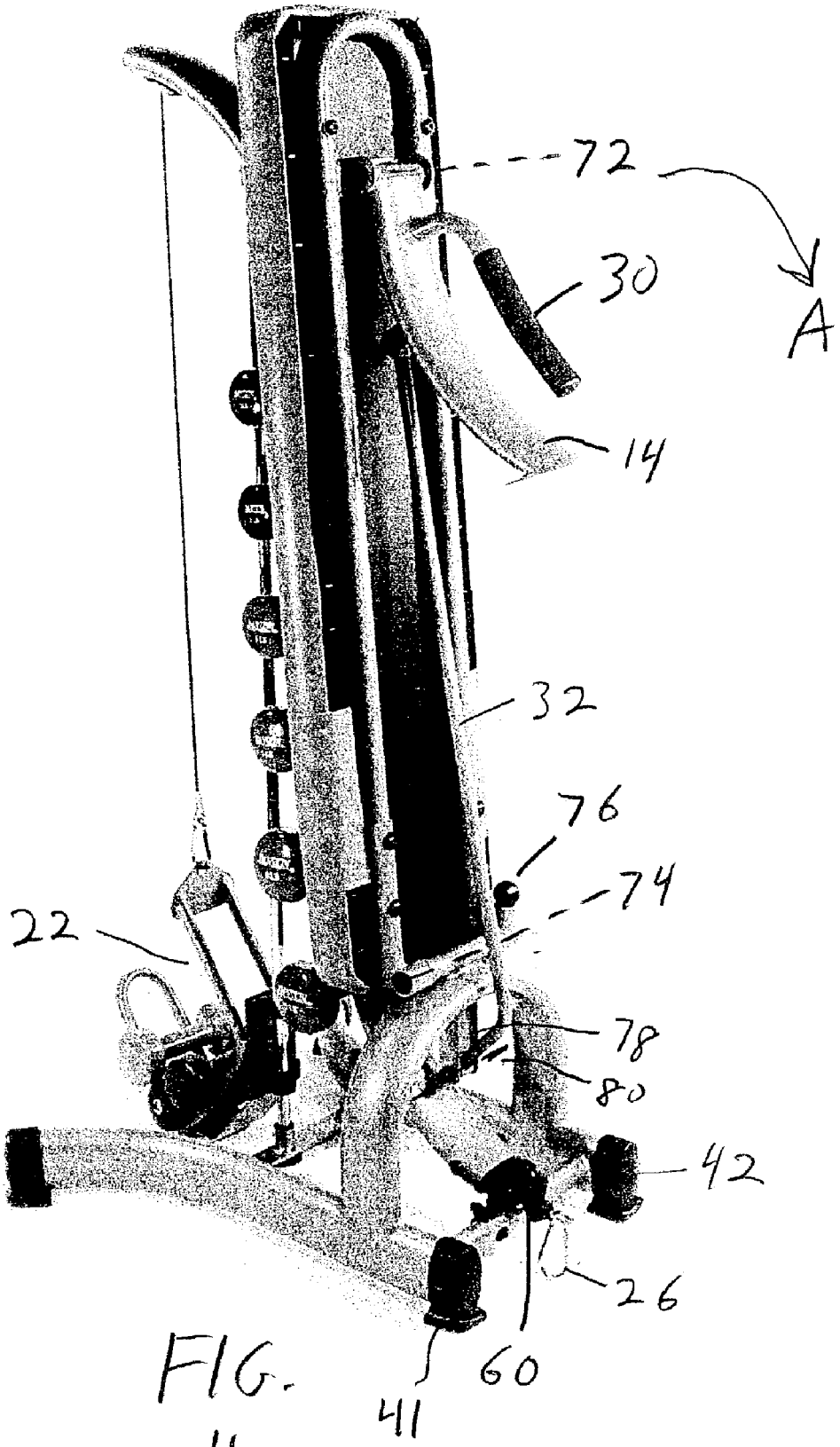
FIG. 4 is a front angle perspective view of the device of FIG. 1 with the bench in the upright stowed position, which provides access to the lower cable station.

FIG. 4 helps to understand both how the device is used with the bench stowed, and how the bench is stowed. The bench can pivot about horizontal pivot axis 74 as controlled by locking member 76 that is shown in more detail in FIG. 7. Optional pivoting connector rod 32 pivots about horizontal axis 80. Bench support leg 14 may be fixed or may pivot about horizontal axis 72. Handle 30 attached to leg 14 allows the user to manipulate the bench up and down, and also can be grasped by the user while in the bench up position shown in FIG. 4, when the user is exercising and needs balance, and when the user is using the lower cable station for some types of exercises. Also it can be seen from this drawing that if end caps 41 and 42 also include wheels, the device could be grasped by handle 30 and tipped forward in the direction of arrow A to balance the device on the two wheels and thus be easily moved. This allows the device to be folded up and moved from or to a storage location.

Figure 5:
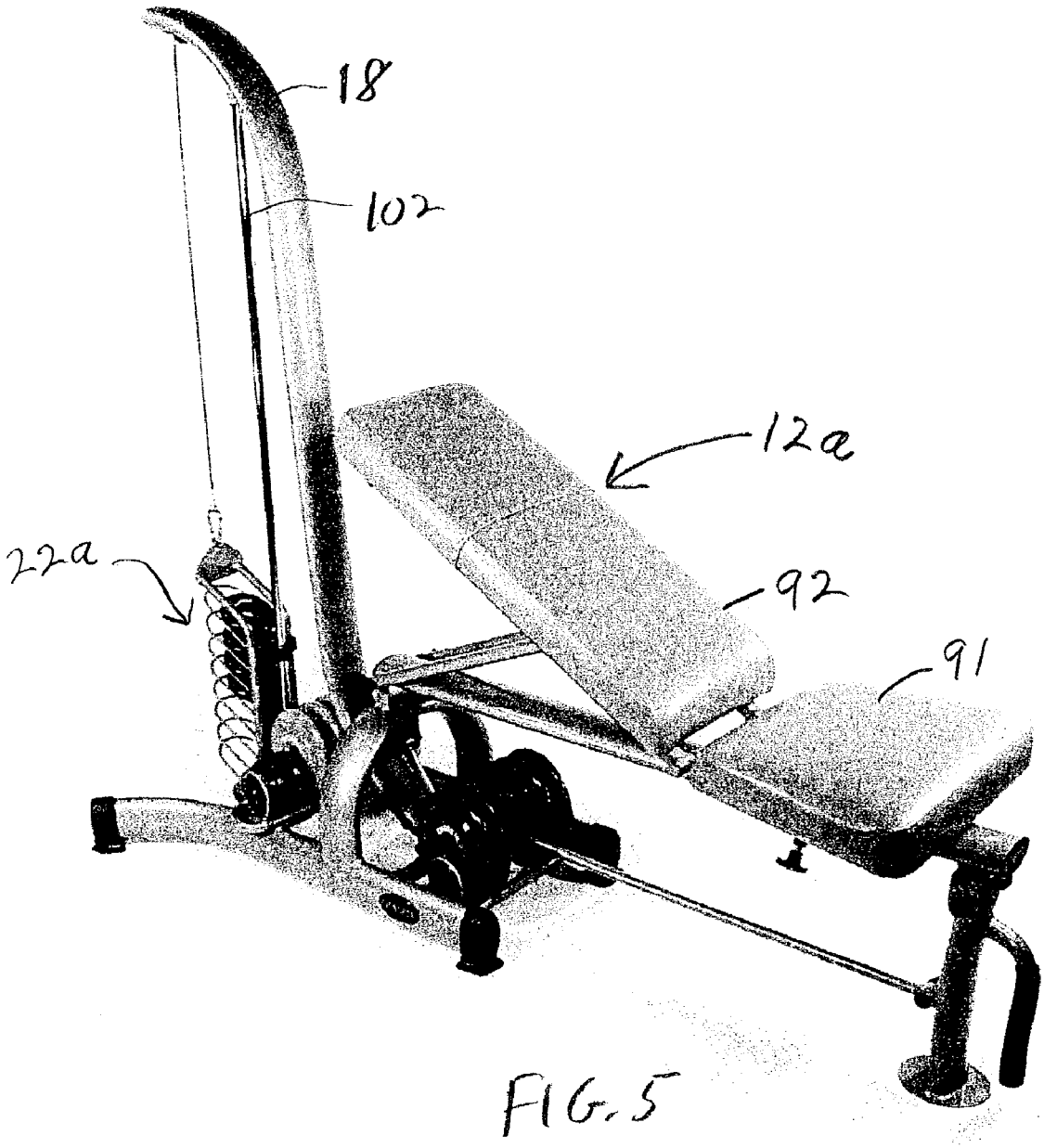
FIG. 5 is a view similar to that of FIG. 1 for an alternative embodiment showing a split bench with an adjustable angle back and a weight-carrying saddle adapted to carry plates rather than dumbbells.
Figure 8:
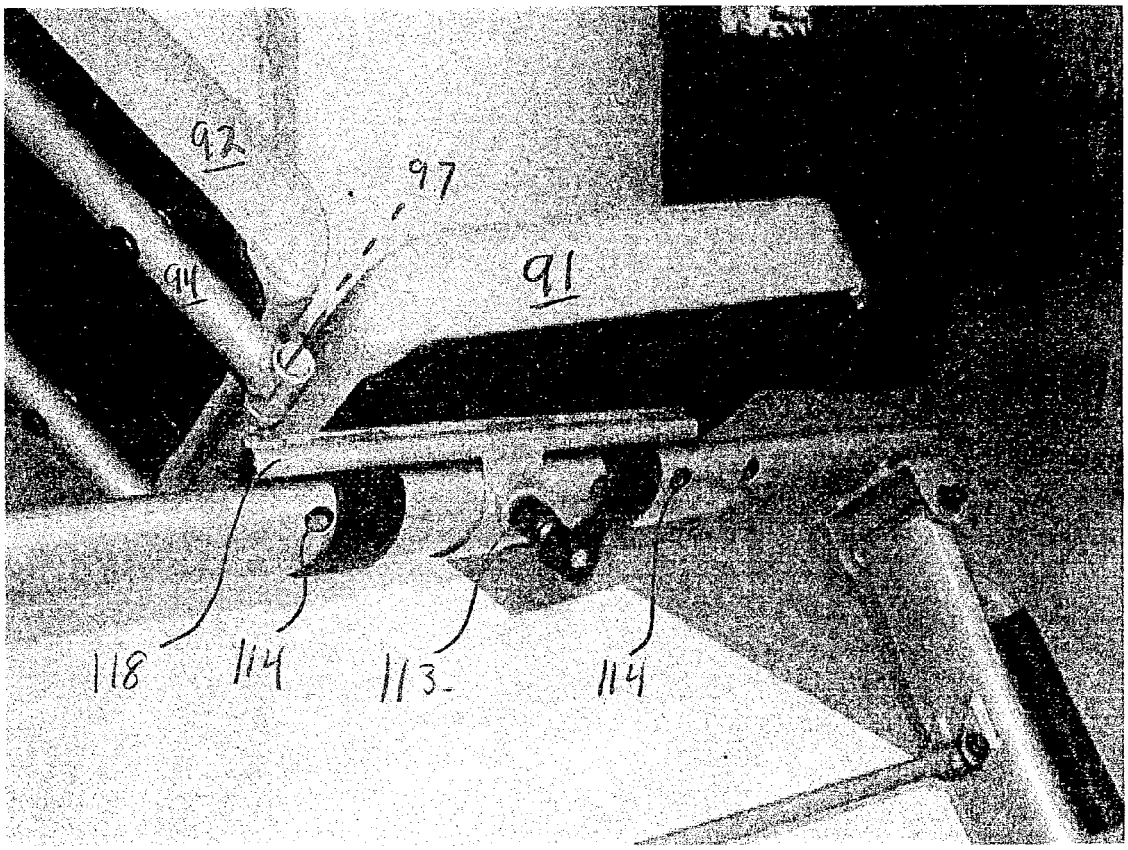
FIG. 8 is a bottom view of the seat portion of the embodiment of FIG. 5, showing some of the seat back pivoting and seat adjustment mechanisms of the device.
Figure 9:
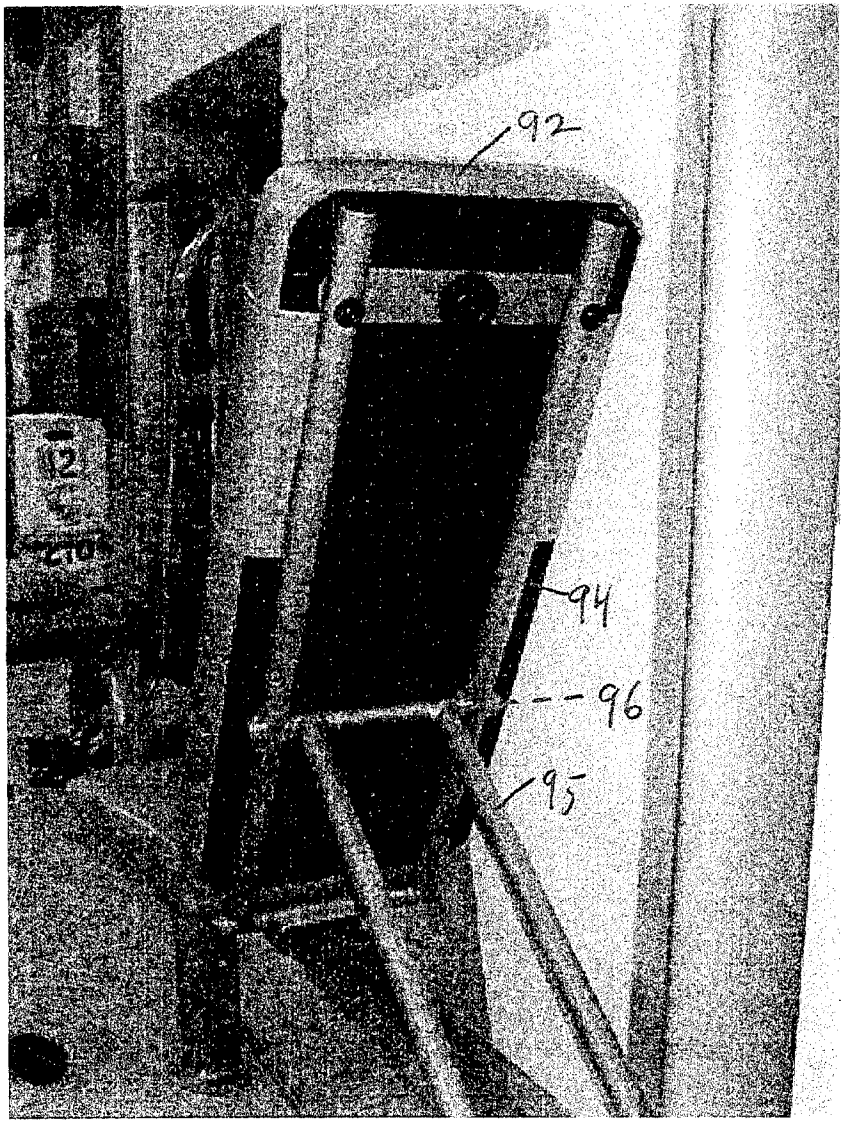
FIG. 9 is a rear view of the device showing FIG. 8 detailing more of the pivoting seat back support construction for the device.
Figure 10:
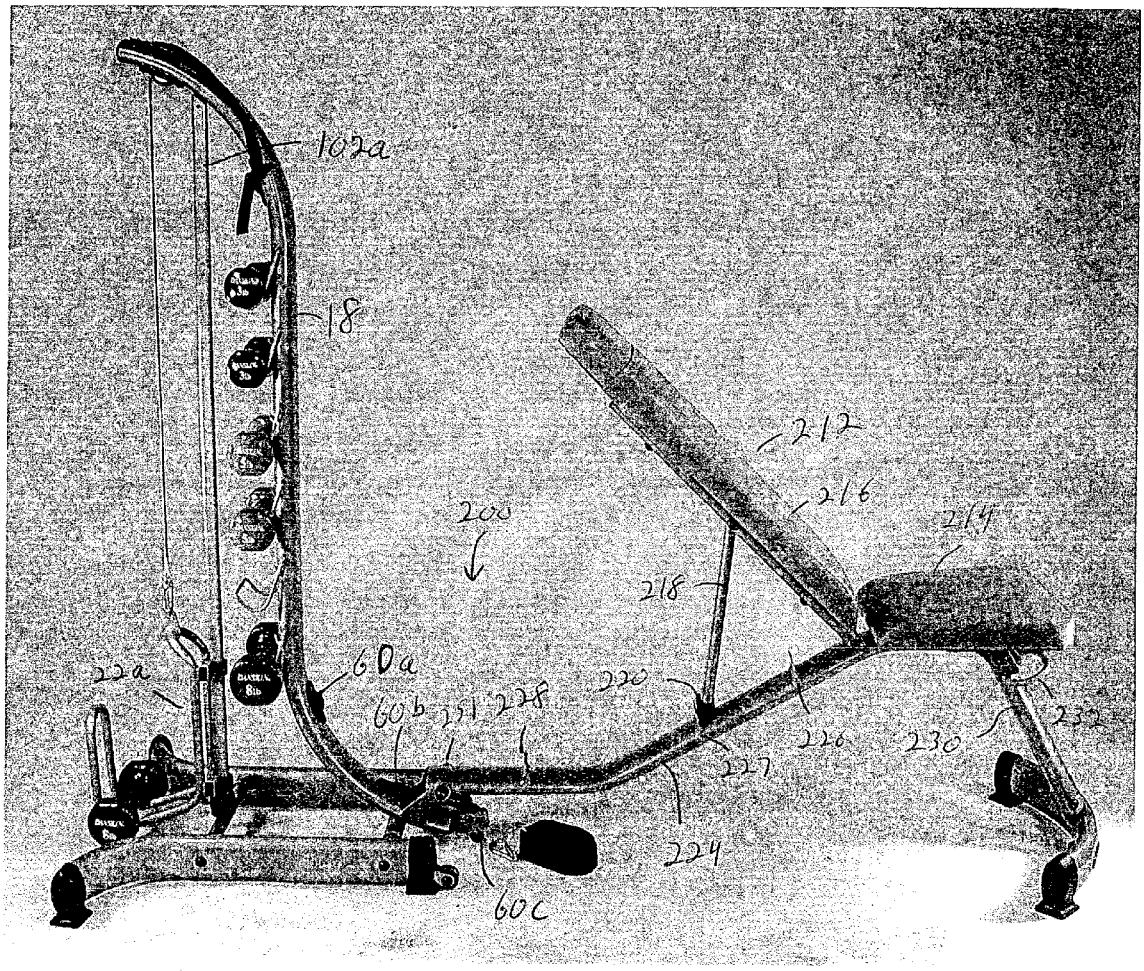
FIG. 10 is a perspective view of another preferred embodiment of the invention with a different split bench design and a different weight saddle design.

The alternative embodiment in FIG. 5 illustrates two primary alternatives to two of the features of the other preferred embodiment. One is illustrated by weight-carrying saddle 22*a* which comprises a magazine that can hold a plurality of weight plates. The second is that bench 12*a* is split into horizontal bench seat portion 91 and adjustable angle bench back portion 92. One embodiment of an adjustment and support for bench 12*a* is shown in more detail in FIGS. 8 and 9. Bench back portion 92 is supported by back support structure 94 which pivots about horizontal axis 97. Seat position adjustment member 113 includes a projecting portion that can be inserted into or pulled out of openings 114 to provide locking adjustment of the position of seat portion 91. Since seat portion 92 is pivotably coupled to portion 91, adjustment of the position of portion 91 defines the seat back angle of portion 92. Portion 92 is supported by support structure 94 and adjustment support structure 95 that pivots about horizontal axis 96 to provide for the adjustable back angle.

Figure 6:
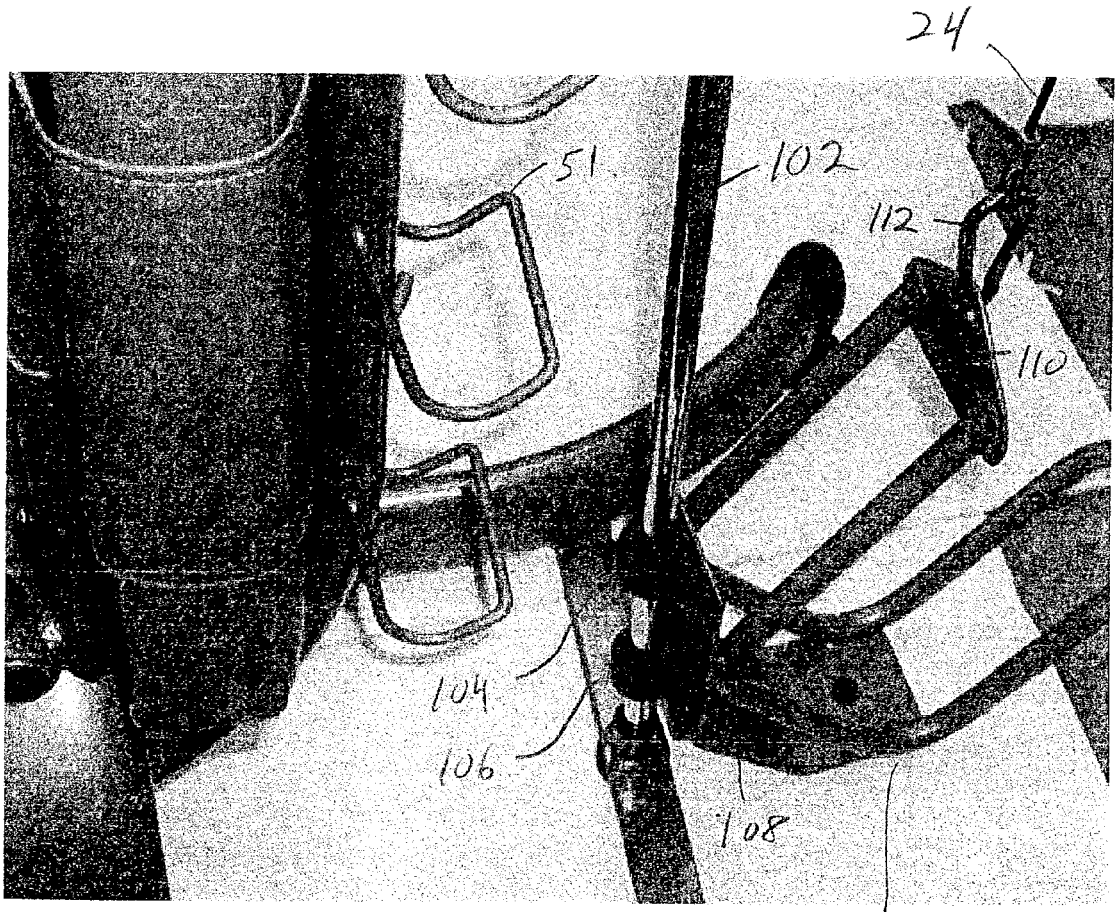
FIG. 6 is a close up view of the lower rear portion of the device of FIG. 1.
Figure 7:
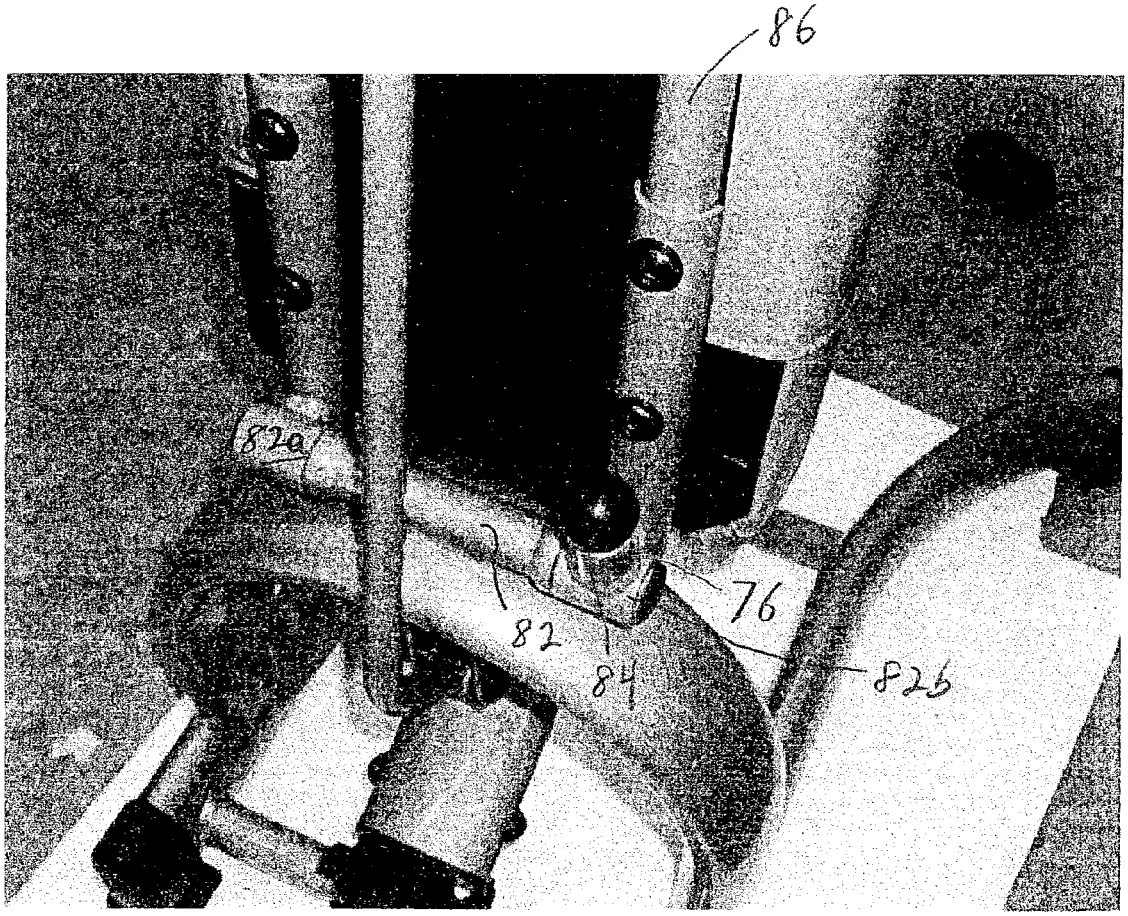
FIG. 7 is a close up view of the lower portion of the stowed bench from the position shown in FIGS. 2–4, detailing the bench pivot and locking mechanism.

FIGS. 6 and 7 show in more detail as described above, saddle 22, one dumbbell-supporting member 51 of rack 50, and the pivoting and locking mechanism for bench 12. Saddle 22 may be constructed in the manner shown in FIG. 6 or that shown in FIG. 5, but that is not a limitation of the invention. The saddle construction shown in FIG. 6 holds one or more dumbbells that also can be held in member 51. The saddle is shown having a general "V" shape with a narrow bottom portion and flared sides defining wider upper portion. Saddle 22 is interconnected to cable 24 with quick release snap 112 that fits in an opening in upper connector member 110. Bushings 104 and 106 are attached to lower connector member 108 and wrap around rod 102 to constrain the position of saddle 22 so that it rides up and down smoothly as the lower cable station is used. Other saddle designs that accomplish the goal of holding dumbbells or weights are also contemplated herein.

FIG. 7 shows seat locking pin support cylinder 82 with pivoting ends 82*a* and 82*b* to which bench support structure 86 is coupled. Handle 84 moves the pin carried in cylinder 82, which forms part of bench lock 76, to allow the manual locking and unlocking of the bench so that it can be held in or released from the stowed position shown in FIG. 7.

Embodiment 200 shown in FIGS. 10–14 has a different bench arrangement and a different weight type and carrying saddle arrangement. Embodiment 200 includes split bench 212 with seat portion 214 and adjustable angle back portion 216 supported by back support 218 with distal end 220 that is adapted to sit against one of spaced support plates 226, 227 and 228. Bench support bar 224 is pivotably attached at point 251 to cable riser 18. Support leg 230 is pivotably attached at point 250 to the other end of support 224. Handle 232 is grasped by the user to fold and unfold the bench portion as described below.

Figure 11:
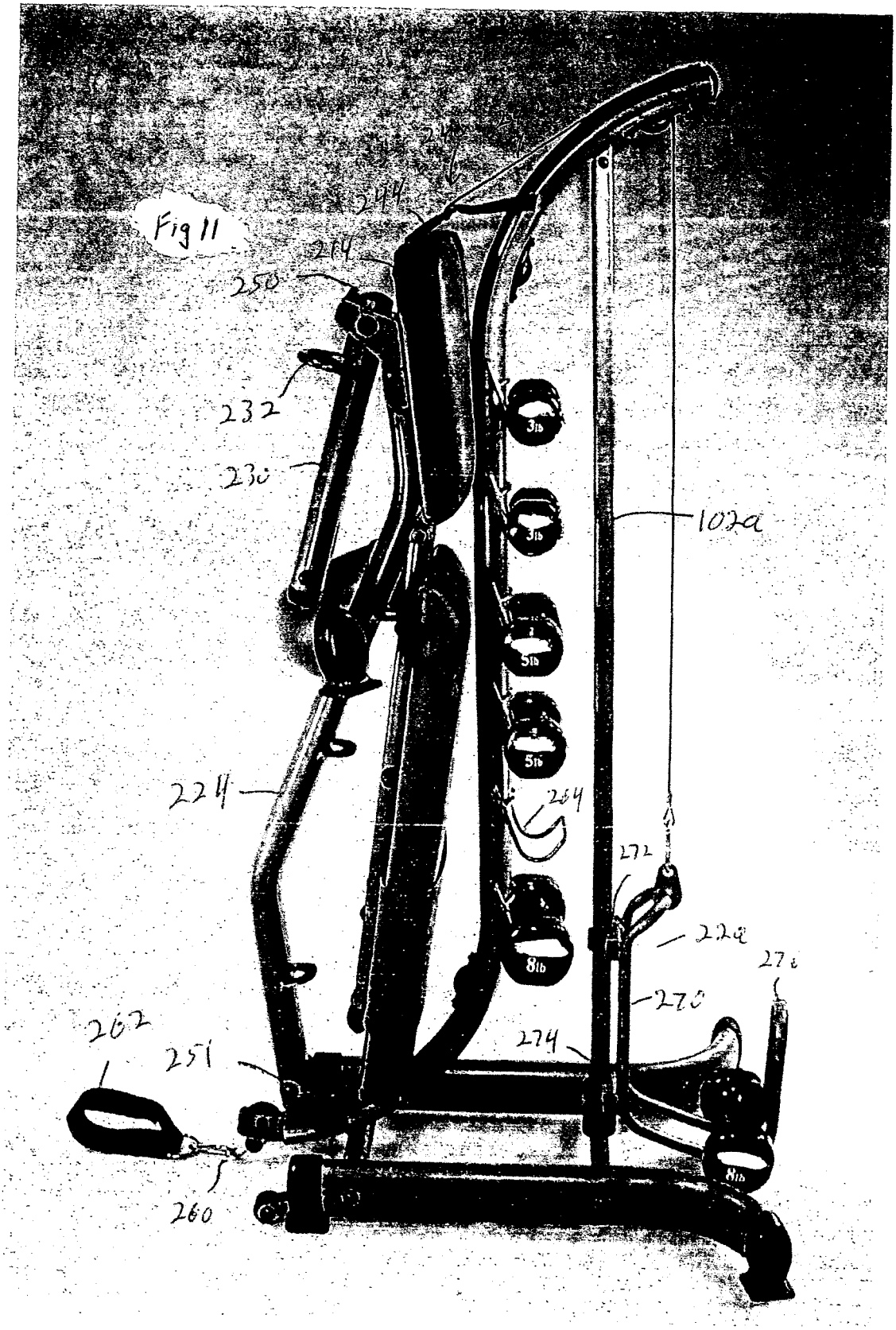
FIG. 11 is a side view of the embodiment of FIG. 10 in the folded position for storage.
Figure 12:
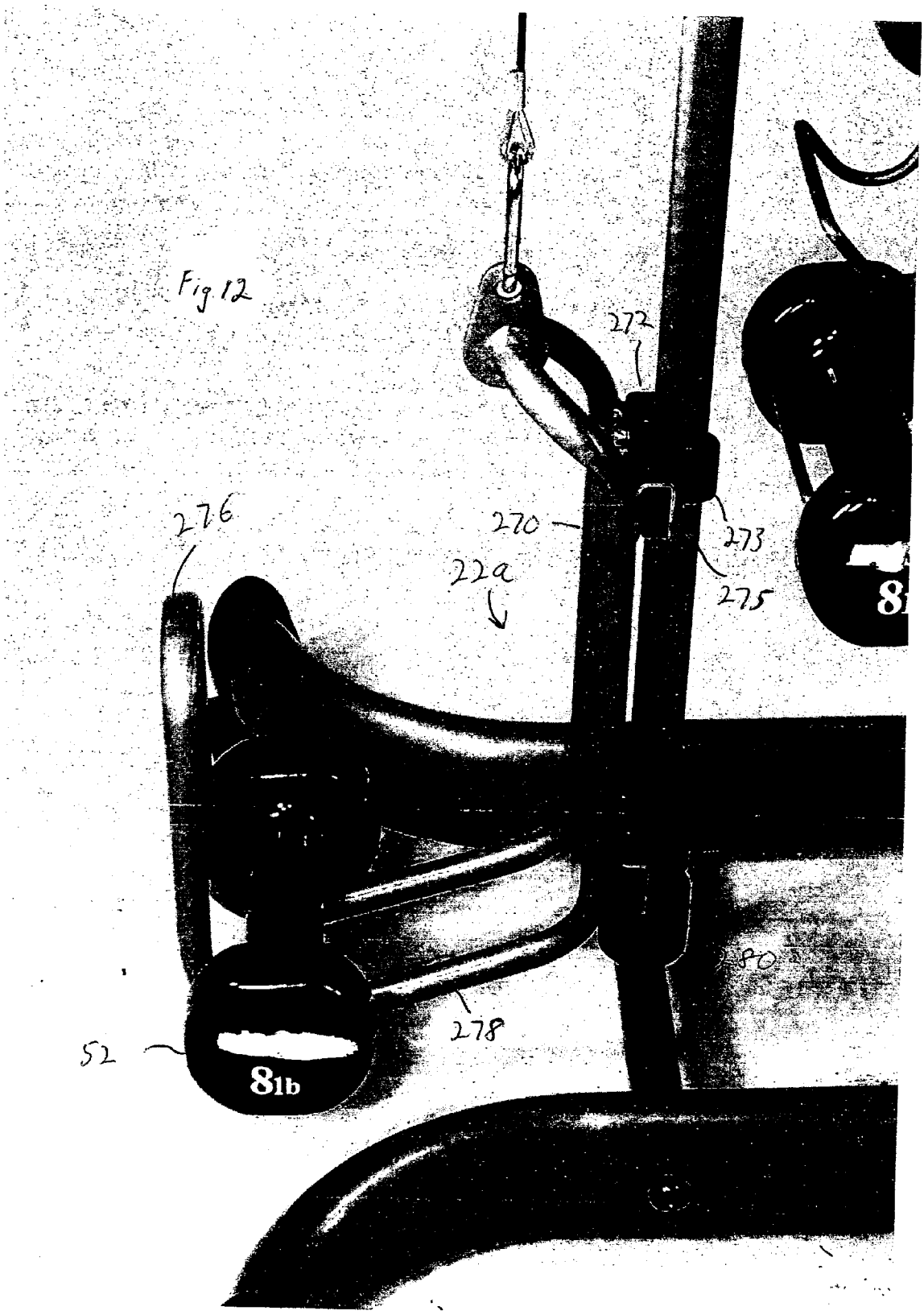
FIG. 12 is a close up view of the weight-carrying saddle of the embodiment of FIGS. 10 and 11.

In the folded position shown in FIG. 11, seat portion 214 is releasably coupled to cable riser 18 by use of adjustable length strap and buckle arrangement 242 and 244. From the stowed position shown FIG. 11, the bench is deployed by releasing buckle 240 and lowering the bench by use of handle 242 while at the same time pivoting support 230 about point 250 so that it extends outward to its maximum support angle to the position shown in FIG. 10. Seat back 216 can then be placed in a desired position between horizontal and vertical.

Weight-carrying saddle 22*a* includes vertical section 270 that is coupled to saddle travel rod 102*a* by sliding couplings 272 and 274 that each comprise a bushing 273 received within a metal bracket 275. In this embodiment, rod 102*a* has a generally rectangular cross section that is matched by bushing 273 to provide for smooth up and down movement, and to inhibit side-to-side motion of saddle 22*a*. Sloped section 278 and vertical rearward section 276 define a volume into which barbells or weighted balls can be placed to allow the user to place a desired amount of weight in the lower cable station device.

Figure 13:
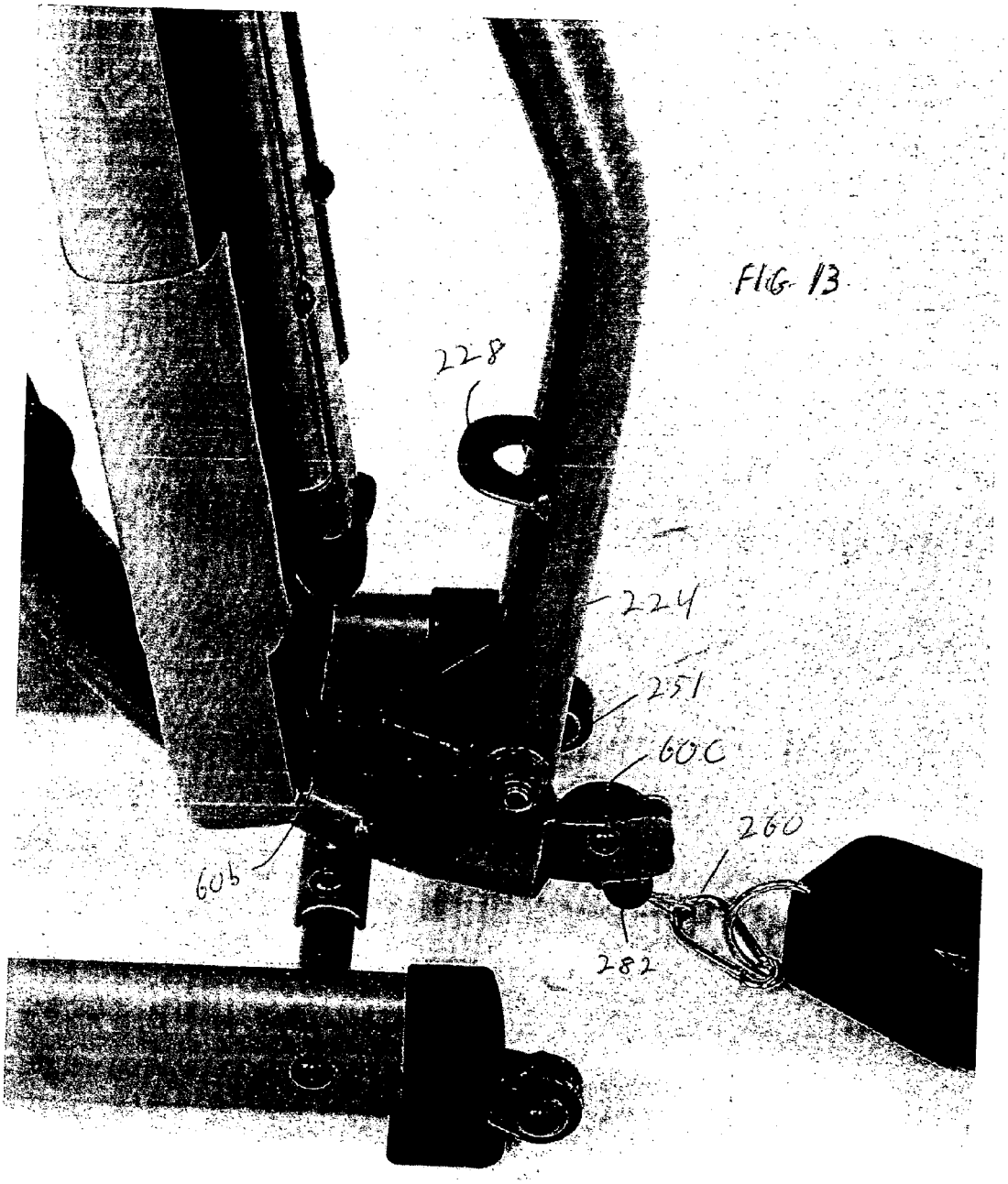
FIG. 13 is a close up view of the pivoting seat support and the lower cable station device of the embodiment of FIGS. 10–12.

Shown in more detail in FIG. 13 is the preferred arrangement of the lower end of the lower cable station, showing guide pulleys 60*b* and 60*c* and cable stop enlarged portion 282 that prevents the cable from pulling all the way back into riser 18. Clip or other releasable attachment mechanism 260 allows for the quick attachment and detachment of a handle strap or other structure that is the user interface to the cable.

Figure 14:
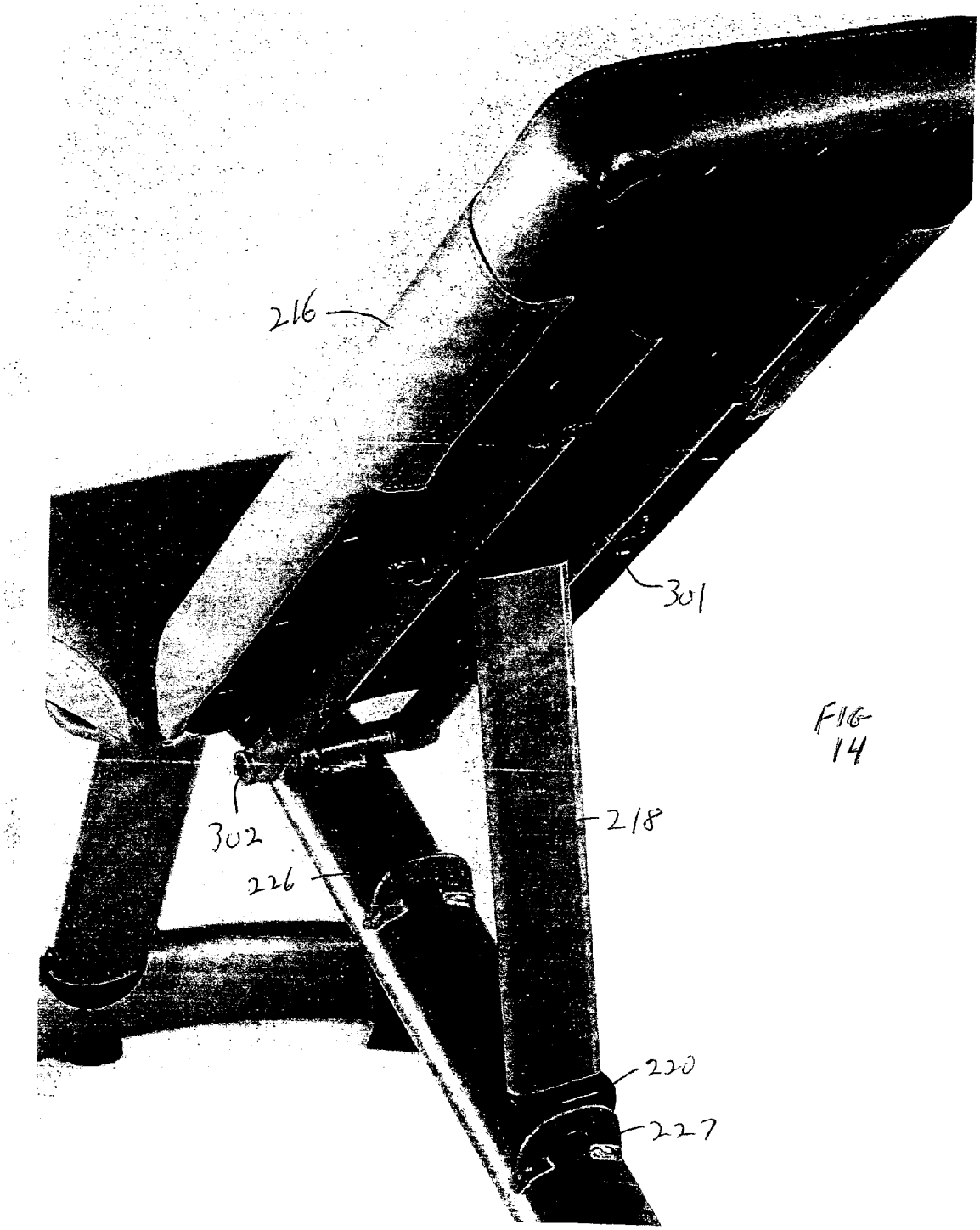
FIG. 14 is a close up view of the seat back support mechanism of the embodiment of FIGS. 10–13.

FIG. 14 details the adjustable seat back support of this embodiment, in which support 218 pivots about point 301 and has end 220 that sits against the upper surface of one of stops 226, 227 and 228. This holds seat back 216 at any one of three angles as desired by the user.

Figure 15:
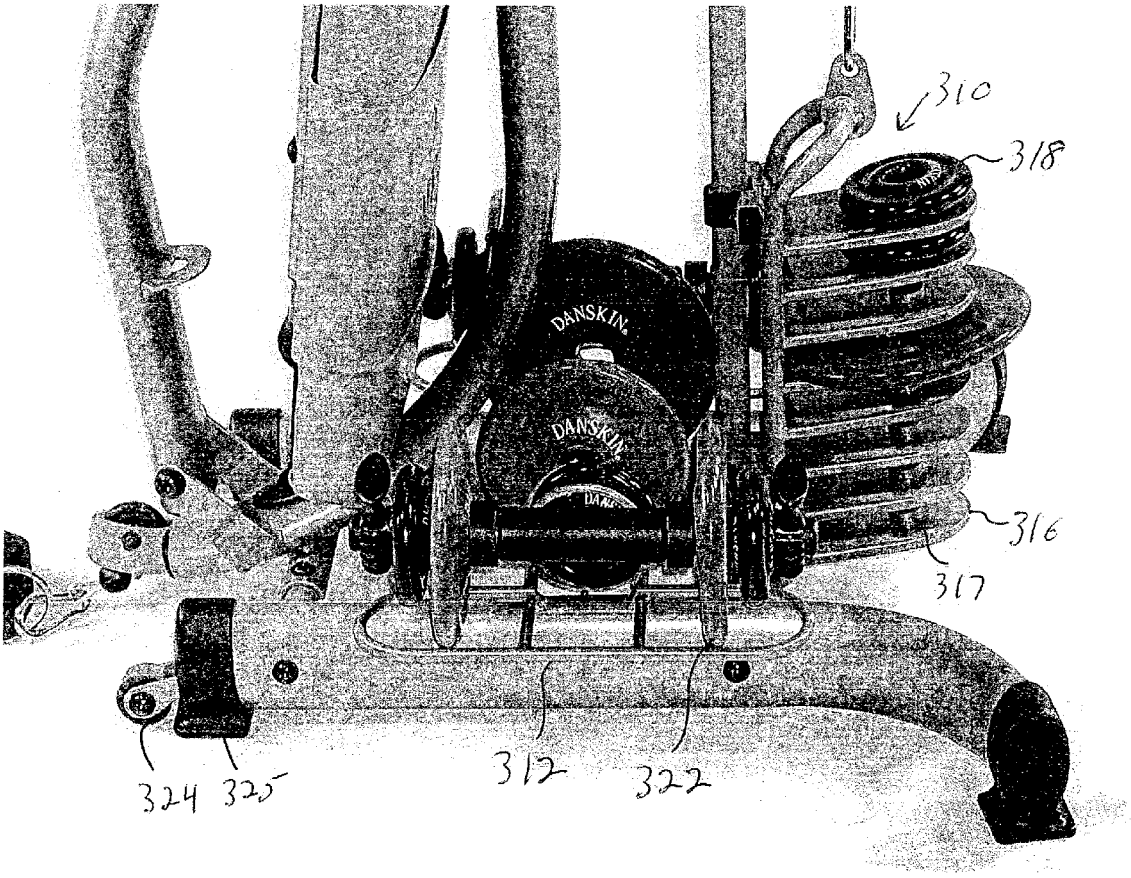
FIG. 15 is a side view of another alternative embodiment adapted to store and carry weight plates.
Figure 16:
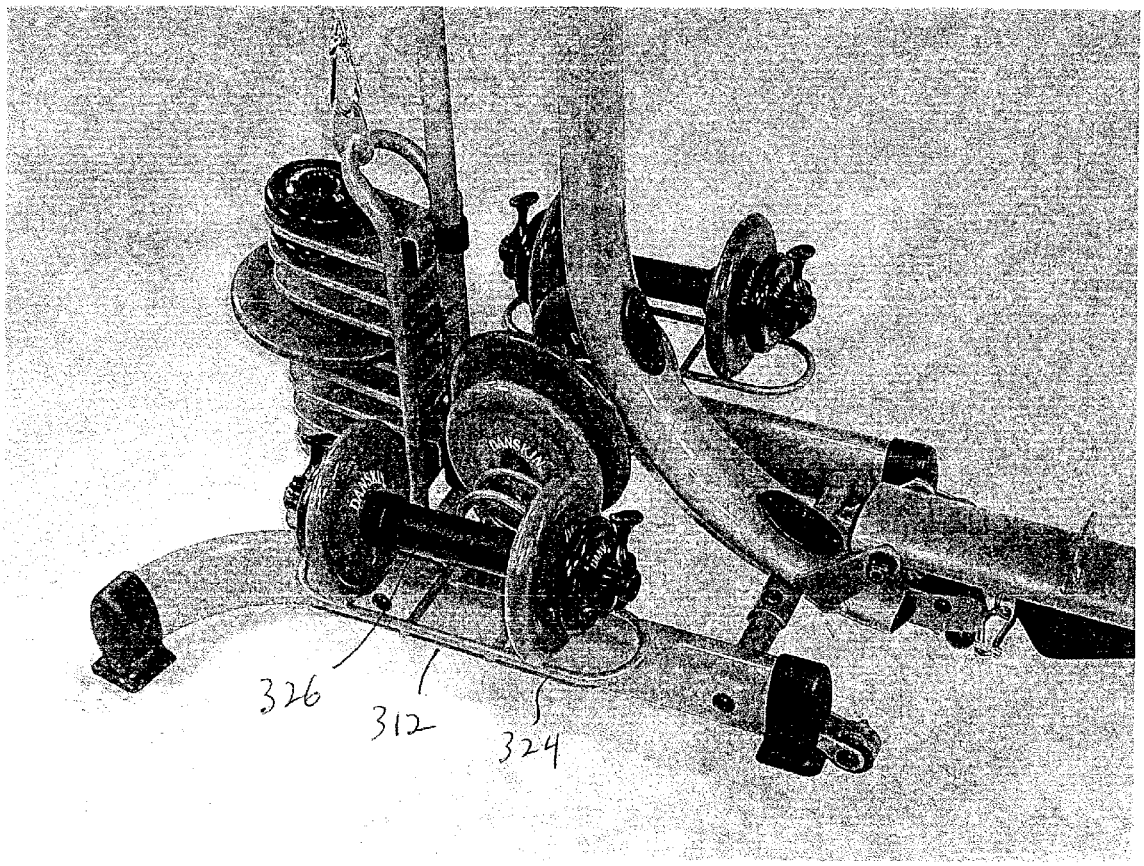
FIG. 16 is another view of the embodiment of FIG. 15.

FIGS. 15 and 16 show an alternative arrangement that is adapted to carry weight plates rather than dumbbells or weighted balls. In this arrangement, weight-carrying saddle 310 includes a series of slightly inclined plate supports 316 that can have protrusions 317 over which the central opening in a weight plate 318 can be placed, to prevent the weight plate from moving in the saddle as the saddle moves up and down as the cable station is used. Other arrangements are contemplated, such as other saddles or baskets that can carry one or more weight plates. This embodiment also includes weight plate storage structure 312 that can take a desired form. In this embodiment, structure 312 includes a number of slots that can carry a weight plate defined between wire sections 326. Also shown are end supports 324 that can accept a small dumbbell as shown in the drawings.

Figure 17:
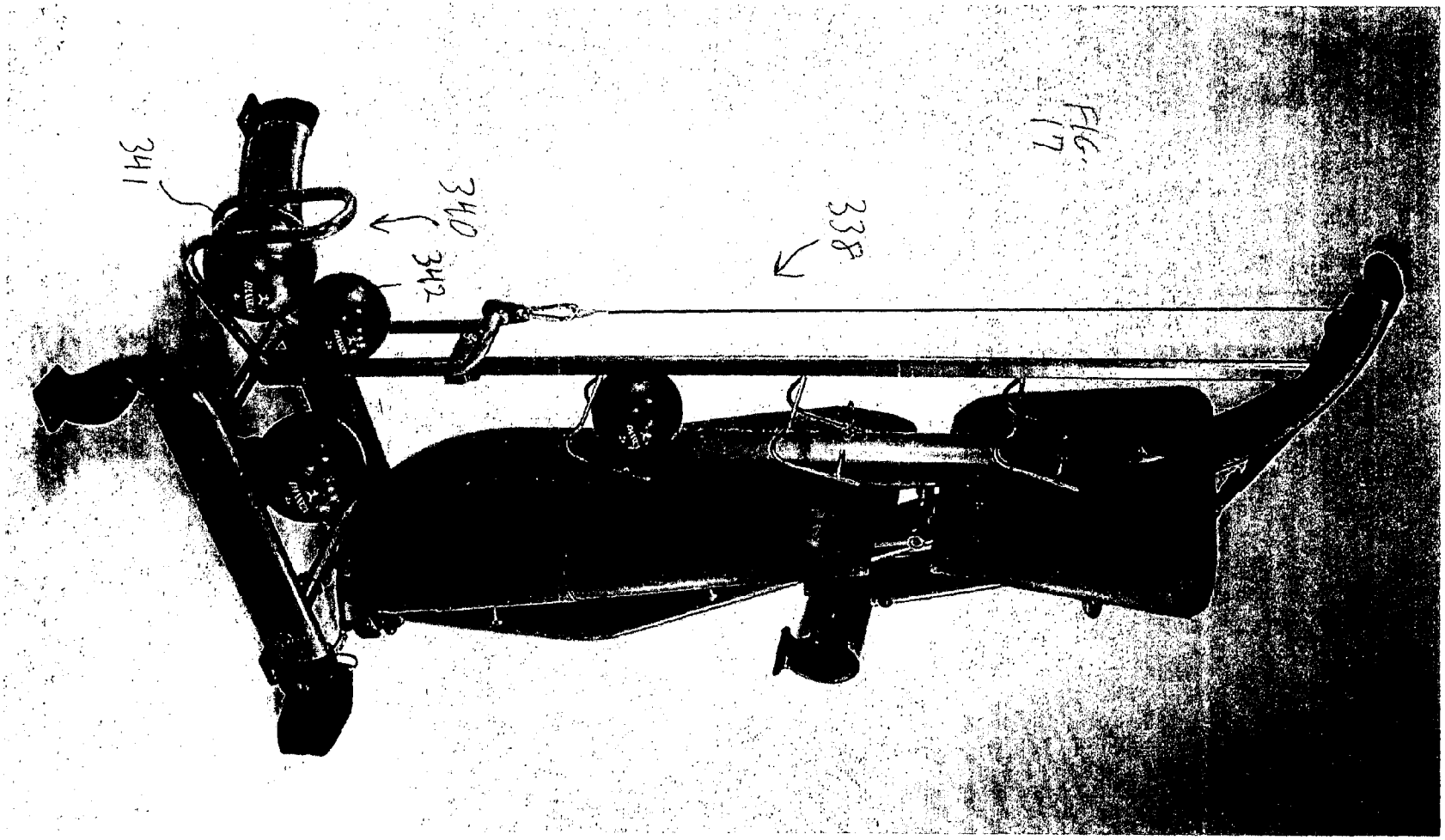
FIG. 17 is rear perspective view of yet another embodiment of the invention adapted to carry and use weighted balls.

FIG. 17 shows another alternative saddle arrangement 340 that is adapted to carry weighted balls such as balls 341 and 342.

Although specific features of the invention are shown in some drawings and not others, this is for convenience only as some feature may be combined with any or all of the other features in accordance with the invention.

Other embodiments will occur to those skilled in the art and are within the following claims:

The invention claimed is:

1. A combined exercise/weight bench/lower cable station device, comprising:

a bench;

bench support means for supporting the bench in a generally horizontal use position;

means for pivoting the bench from the use position to an upright, stowed position;

a mechanical device for holding the bench in the upright, stowed position;

a generally "S"-shaped cable riser, the cable riser having an intermediate generally vertical portion located spaced from and proximate one end of the bench when the bench is in the use position, a curved lower end portion curving forward toward the bench, with its end located lower than the bench when the bench is in the use position, and a curved upper end portion that curves away from the bench and curves away from the lower end portion;

a weight-carrying saddle located below the upper end of the cable riser;

a cable coupled to the saddle and in sliding engagement with the cable riser, the cable engaged with at least the upper end of the riser and the lower end of the riser; and a structure, coupled to the cable proximate the lower end of the riser, that is the user interface to the cable.

2. The device of claim 1 wherein the saddle is generally "U" shaped.

3. The device of claim 2 wherein the saddle defines a narrow bottom portion and a progressively wider higher portion.

4. The device of claim 1 wherein the saddle comprises a plate rack.

5. The device of claim 1 further comprising a generally vertical saddle travel rod along which the saddle moves up and down as the saddle is pulled by the cable.

6. The device of claim 5 wherein the saddle travel rod has a cross-sectional shape that is not round.

7. The device of claim 6 wherein the cross sectional shape of the saddle travel rod is rectangular.

8. The device of claim 1 wherein the bench support means comprises a front support leg.

9. The device of claim 8 wherein the front support leg comprises an integral lift and user-support handle.

10. The device of claim 1 wherein the bench is split into a seat and back portion, and the back portion is supportable in a number of positions.

11. The device of claim 1 wherein the cable is in part located inside of the cable riser.

12. The device of claim 11 further comprising a plurality of cable-directing pulleys in the riser, to inhibit the cable from binding in the riser.

13. The device of claim 12 in which there are at least four such pulleys, one proximate each end of the riser to direct the cable into and out of the riser, and one proximate each bend in the riser at which the intermediate portion meets the lower and upper end portions, to inhibit the cable from binding on a bend.

14. The device of claim 11 wherein the cable enters the riser near the top of the riser, and exits the riser at the lower end, and between is located within the riser.

15. The device of claim 1, further comprising one or more weight-holding devices coupled to the riser.

16. The device of claim 1, further comprising a rack supported by the stand, the rack adapted to hold weight plates.

17. A combined exercise/weight bench/lower cable station device, comprising:

a bench;

a front support leg with an integral lift and user-support handle, the leg for supporting the bench in a generally horizontal use position;

means for pivoting the bench to an upright, stowed position;

a mechanical device for holding the bench in the upright, stowed position;

a cable riser that is generally "S" shaped, the cable riser having an intermediate generally vertical portion located spaced from and proximate one end of the bench when the bench is in the use position, a curved lower end portion curving forward toward the bench, with its end located lower than the bench when the bench is in the use position, and a curved upper end portion that curves away from the bench and curves away from the lower end portion;

a cable located in part within the riser;

a number of cable-directing pulleys in the riser, to inhibit the cable from binding in the riser;

a weight-carrying saddle located directly below the upper end portion of the riser and coupled to one end of the cable;

the other end of the cable extending from the lower portion of the riser underneath the bench while the bench is in the use position; and a generally vertical saddle travel rod along which the saddle moves up and down as the saddle is pulled by the cable, wherein the saddle travel rod has a cross-sectional shape that is not round, to inhibit rotation of the saddle about the saddle travel rod.

18. The device of claim 1, further comprising a stand for supporting the cable riser and one end of the bench.

* * * * *